US008622616B2

(12) United States Patent
Petkovsek

(10) Patent No.: US 8,622,616 B2
(45) Date of Patent: Jan. 7, 2014

(54) RECLOSABLE DOUBLE ZIPPER AND METHODS

(75) Inventor: Gregory L. Petkovsek, Waupaca, WI (US)

(73) Assignee: Reynolds Presto Products, Inc., Richmond, VA (US)

( * ) Notice: Subject to any disclaimer, the term of this patent is extended or adjusted under 35 U.S.C. 154(b) by 464 days.

(21) Appl. No.: 12/793,252

(22) Filed: Jun. 3, 2010

(65) Prior Publication Data

US 2011/0299797 A1 Dec. 8, 2011

(51) Int. Cl.
*B65D 33/16* (2006.01)

(52) U.S. Cl.
USPC ..... 383/63; 383/61.2; 24/400; 24/399

(58) Field of Classification Search
USPC ..... 383/61.2, 61.3, 63, 64; 24/400, 399, 24/401, 402
See application file for complete search history.

(56) References Cited

U.S. PATENT DOCUMENTS

| | | | | |
|---|---|---|---|---|
| 5,664,299 | A * | 9/1997 | Porchia et al. | 24/400 |
| 6,217,215 | B1 | 4/2001 | Tomic | |
| 6,287,001 | B1 | 9/2001 | Buchman | |
| 6,293,701 | B1 * | 9/2001 | Tomic | 383/64 |
| 6,364,530 | B1 * | 4/2002 | Buchman | 383/64 |
| 6,467,956 | B1 * | 10/2002 | Tilman et al. | 383/61.3 |
| 6,517,242 | B1 | 2/2003 | Buchman | |
| 6,595,689 | B1 * | 7/2003 | Borchardt et al. | 383/64 |
| 6,739,755 | B2 * | 5/2004 | Schreiter | 383/64 |
| 6,843,600 | B2 * | 1/2005 | Tilman et al. | 383/5 |
| 6,846,108 | B2 * | 1/2005 | Buchman | 383/64 |
| 6,974,256 | B2 * | 12/2005 | Kinigakis et al. | 383/64 |
| 7,052,181 | B2 * | 5/2006 | Smith et al. | 383/64 |
| 7,137,736 | B2 | 11/2006 | Pawloski et al. | |
| 7,137,942 | B2 * | 11/2006 | Savicki et al. | 493/213 |
| 7,305,742 | B2 * | 12/2007 | Anderson | 24/400 |
| 7,410,298 | B2 | 8/2008 | Pawloski | |
| 7,674,040 | B2 | 3/2010 | Dowd et al. | |
| 8,021,048 | B2 * | 9/2011 | Ackerman | 383/64 |
| 2002/0064322 | A1 * | 5/2002 | May | 383/64 |
| 2003/0235347 | A1 * | 12/2003 | Kinigakis et al. | 383/5 |
| 2004/0022461 | A1 * | 2/2004 | Schreiter | 383/64 |
| 2004/0066984 | A1 * | 4/2004 | Yi Li | 383/64 |
| 2004/0136615 | A1 * | 7/2004 | Tilman et al. | 383/5 |
| 2005/0196077 | A1 * | 9/2005 | Ootsubo et al. | 383/64 |
| 2005/0220372 | A1 * | 10/2005 | Withers | 383/64 |
| 2005/0281490 | A1 * | 12/2005 | Schneider et al. | 383/61.2 |
| 2007/0047850 | A1 * | 3/2007 | Keith et al. | 383/64 |
| 2007/0110340 | A1 * | 5/2007 | Buchman | 383/5 |
| 2008/0156685 | A1 * | 7/2008 | Pham | 206/524.8 |
| 2010/0254635 | A1 * | 10/2010 | Clements et al. | 383/64 |

* cited by examiner

*Primary Examiner* — Jes F. Pascua
*Assistant Examiner* — Peter Helvey
(74) *Attorney, Agent, or Firm* — Merchant & Gould P.C.

(57) ABSTRACT

A reclosable bag includes first and second side edges and a double zipper, which includes first zipper with first side seal adjacent the first side edge and second side seal adjacent the second side edge. The double zipper includes second zipper having third side seal adjacent the first side edge, and fourth side seal adjacent to the second side edge. One of the first side seal and third side seal has an end that is spaced closer to the second side edge than the other. A method for providing a sensory indication of double sealing in a reclosable bag includes closing a mouth by pressing opposing fingers against first and second zipper closures and moving opposing fingers linearly across the closures until there is a sensory indication of an end seal for each of the first and second zipper closures at different linear locations.

12 Claims, 4 Drawing Sheets

RECLOSABLE DOUBLE ZIPPER AND METHODS

TECHNICAL FIELD

This disclosure concerns reclosable zipper arrangements for plastic bags. In one preferred implementation, this disclosure concerns a double zipper having a double audible feature.

BACKGROUND

Thermoplastic bags for the storage of items typically include closure arrangements comprising interlocking closure elements or profiles attached to an inner surface of a bag wall.

Various zipper closures have been developed. One example is a double zipper, as described in U.S. Pat. No. 7,137,736, incorporated herein by reference. In U.S. Pat. No. 7,137,736, first and second closure mechanisms are disposed on the internal sides of first and second bag walls. The closure mechanisms are parallel and spaced between about 0.1 inch and 0.3 inch apart.

Improvements in zipper closure arrangements are desirable.

SUMMARY

A reclosable bag is provided including a bag surrounding wall defining an enclosure. The bag surrounding wall includes a closed bottom, an open mouth opposite of the closed bottom, a first side edge extending from the mouth to the bottom, and a second side edge opposite of the first side edge extending from the mouth to the bottom. An openable and reclosable double zipper is integral with the bag surrounding wall and is adjacent to the mouth. The double zipper includes a first openable and reclosable zipper closure adjacent to the mouth. The first zipper closure has a first side seal adjacent to the first side edge and a second side seal adjacent to the second side edge. The double zipper also includes a second openable and reclosable zipper closure between the first zipper closure and the closed bottom. The second zipper closure has a third side seal adjacent to the first side edge, and a fourth side seal adjacent to the second side edge. At least one of the first side seal and third side seal has an end that is spaced closer to the second side edge than the other of the first side seal and third side seal.

In another aspect, a method for providing a sensory indication of double sealing in a reclosable bag includes providing a bag including a bag body with a bottom, an open mouth, and an openable and reclosable double zipper for opening and closing the mouth. The double zipper includes a first openable and reclosable zipper closure adjacent to the mouth, and a second openable and reclosable zipper closure between the first zipper closure and the bottom. The method further includes closing the open mouth by pressing opposing fingers against the first and second zipper closures and moving opposing fingers linearly across the first and second zipper closures until there is a sensory indication of an end seal for each of the first and second zipper closures at different linear locations.

In another aspect, a method of making a reclosable bag includes providing an openable and reclosable double zipper including a first openable and reclosable zipper closure and a second openable and reclosable zipper closure. The method includes securing the double zipper to opposing bag walls of a bag body so that the first zipper closure is adjacent an open mouth, and the second zipper closure is between the first zipper closure and a closed bottom. The first and second zipper closures are also secured between a first side edge and a second side edge. The method further includes providing a first side seal adjacent to the first side edge for the first zipper closure, providing a second side seal adjacent to the second side edge for the first zipper closure, providing a third side seal adjacent to the first side edge for the second zipper closure, and providing a fourth side seal adjacent to the second side edge for the second zipper closure. The method further includes making at least one of the first side seal and third side seal to have an end that is spaced closer to the second side edge than the other of the first side seal and third side seal.

It is noted that not all these specific features described herein need to incorporated in an arrangement for the arrangement to have some selected advantage according to the present disclosure.

DETAILED DESCRIPTION

A. Some Problems with Existing Arrangements

When closing a reclosable bag, the user wants to know that the bag is actually closed. That is, the user wants to know that the zipper has fully engaged across the open mouth of the bag. An audible click or a tactile snap aids in informing the user that the reclosable zipper is actually closed. One general way to obtain a good audible click or tactile snap is to have stiff locking members with adequate clearance of the lock tips within the design. Too much clearance, however, can result in leakers at the end.

In the case of a double zipper, there are two sets of locks to produce the audible click or tactile snap when closed. The bag end seal is generally in the same position on each lock. This results in the locks closing at the same time and producing only a single click or snap. Hearing only a single click does not inform the user that both of the zippers in the double zipper have been closed.

B. FIGS. 1-4

FIGS. 1-4 illustrate embodiments of a zipper closure arrangement designed to address the problems of the prior art. In the embodiments of FIGS. 1-4, the reclosable zipper arrangement is a double zipper having at least 2 locking mechanisms, but in other arrangements, could have more than 2. The double zipper is sliderless, in that it operates to open and close without the use of a zipper slider (i.e., it is "slider free.")

The zipper arrangement has a non-uniform side weld on the bags, so that one or more of the reclosable locking mechanisms has a wider side seal on one end (or both ends) than at least one of the other reclosable locking mechanisms. The audible click and/or tactile snap that results when a user closes a reclosable bag occurs at the end seal when the last fraction of an inch of the reclosable zipper is locked together creating a completely closed bag. Having a non-uniform side seal so that individual zipper locking mechanisms are completely closed at different linear points along the bag length will result in individual and distinct clicks and/or snaps at different linear points along the length of the zipper. The user will hear these distinct clicks and/or feel the tactile snap and be informed that the bag is closed tightly through this sensory indication.

Figure 1:
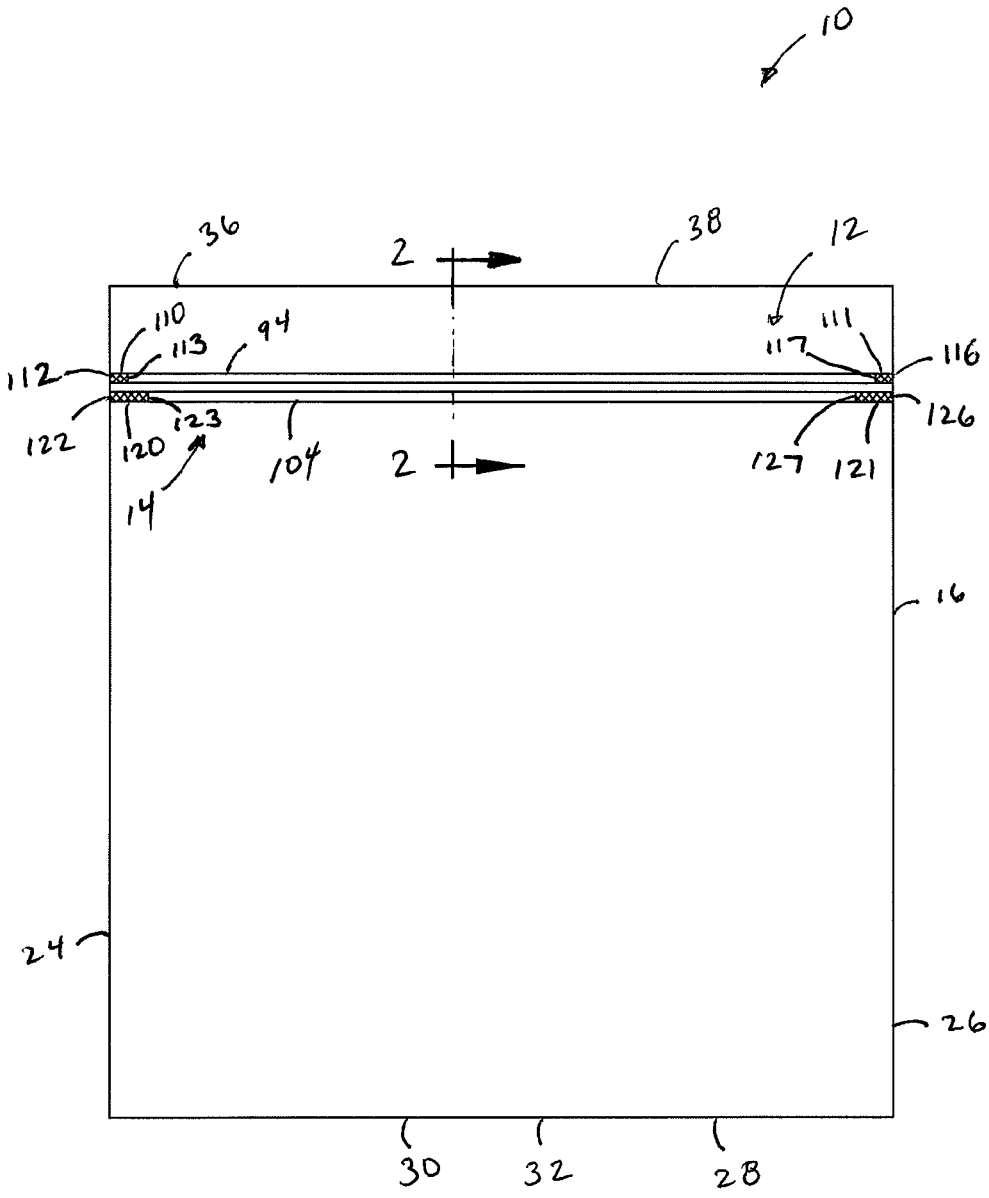
FIG. 1 is a front view of a first embodiment of a reclosable bag constructed in accordance with the principles of this disclosure.

In FIG. 1, one example of a packaging arrangement in the form of a resealable, flexible bag is shown at 10. The bag 10 can be a polymeric package, such as a plastic bag having a resealable closure mechanism 12, for example, a double zipper 14.

Figure 2:
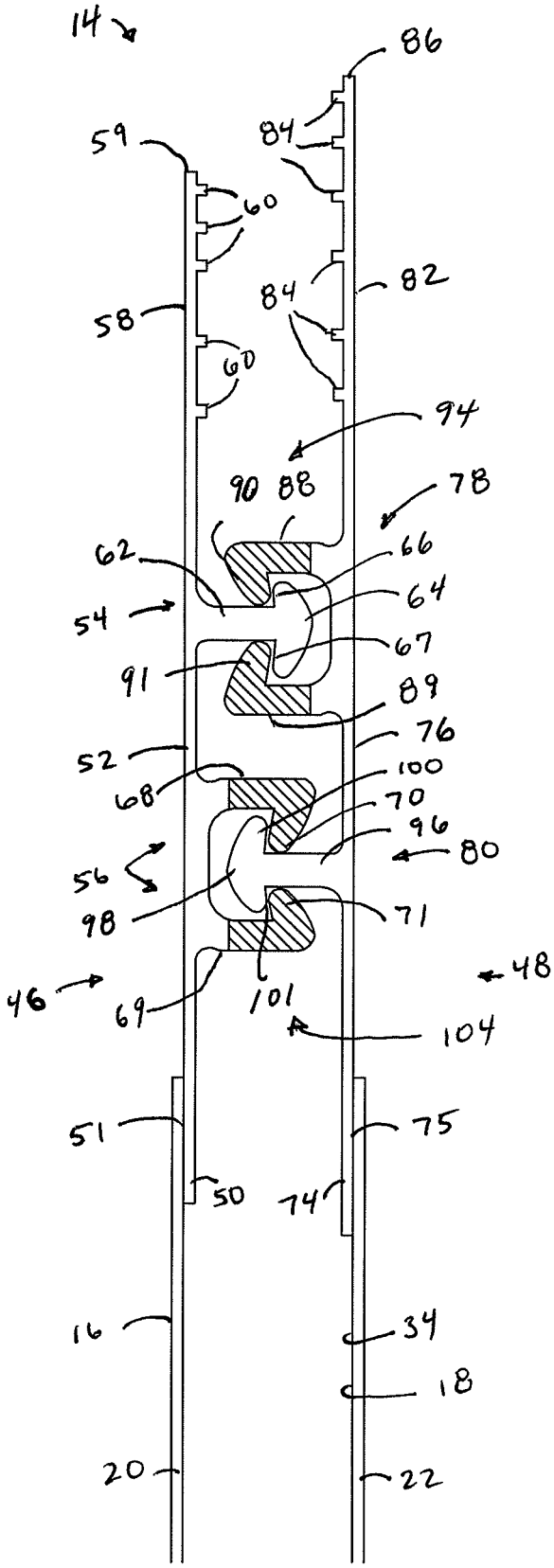
FIG. 2 is a cross-sectional view of the zipper closure used with the reclosable bag of FIG. 1.

The bag 10 includes a bag surrounding wall 16 or bag body defining an enclosure 18 (FIG. 2). In the embodiment shown, the bag surrounding wall 16 includes first and second opposed walls or panel sections 20, 22 (FIG. 2) typically made from a flexible, polymeric plastic film. With some manufacturing techniques, the first and second walls 20, 22 are heat sealed together along a first side edge 24 and a second side edge 26.

The surrounding wall 16 includes a closed bottom 28, which may be formed by a fold line 30 of the polymeric plastic film. In other embodiments, the bottom 28 may be formed by another heat sealed edge, sealing the first and second panel sections 20, 22 together. In the embodiment shown, the fold line 30 comprises the bottom edge 32 of the bag 10.

Access is provided to the interior 34 (FIG. 2) of the bag 10 through a mouth 36 at a top edge 38 of the bag 10. In the embodiment shown, the mouth 36 extends the width of the bag 10. In the embodiment shown, the first side edge 24 extends from the mouth 36 to the bottom 28, while the second side edge 26 extends from the mouth 36 to the bottom 28.

The resealable closure mechanism 12 is illustrated in FIG. 1 adjacent to the mouth 36 of the bag 10. As mentioned above, in this embodiment, the reclosable closure mechanism 12 is embodied as double zipper 14. The double zipper 14 is openable and reclosable and is integral with the bag surrounding wall 16. By the term "integral" it is meant that the double zipper 14 can be either a separately made part that is then permanently secured to the bag surrounding wall 16; or, the double zipper 14 can be a one piece extrusion with the bag surrounding wall 16. In the embodiment of FIG. 2, the double zipper 14 is shown as a separately made piece that is then secured to the bag surrounding wall 16 by techniques such as heat sealing or adhesive.

Use of the double zipper 14 allows for selective opening and closing or sealing of the bag 10 across the mouth 36 to secure the contents of the interior 34.

The double zipper 14 can be one of the variety of closure mechanisms. By the term "zipper" or "zipper closure mechanism" or "resealable closure mechanism", it is meant a structure having opposite interlocking or mating profiled elements that under the application of pressure will interlock and close the region between the profiles. Examples of zipper type closure mechanisms are disclosed in U.S. Pat. No. 6,450,686; 4,240,241; 4,246,288; or 4,437,293, each of which is incorporated by reference herein.

One example embodiment of double zipper 14 is shown in FIG. 2. By the term "double zipper", it is meant at least 2 zippers that are spaced close enough together that the zipping operation to open or close the zippers may be accomplished with a single passage of the fingers across the double zipper 14. That is, opposing fingers may be pressed against opposing sides of the double zipper 14 and slid across the double zipper 14 from one of the side edges 24, 26 to the other of the side edges 24, 26, and this action will close the zippers. The double zipper 14 in FIG. 2 includes elongated first closure profile 46 and an elongated second closure profile 48. Typically, the closure profiles 46, 48 are manufactured separately from each other. This manufacturing may be done by extrusion, for example.

Still in reference to FIG. 2, the first closure profile 46 illustrated includes a sealing flange or bonding strip 50, a base strip 52, a first zipper profile member 54, a second zipper profile member 56, and an upper flange 58. This embodiment includes optional gripper ridges 60 extending from the upper flange 58. A plurality of optional gripper ridges 60 are shown extending therefrom, but none or only a single gripper ridge 60 can be used.

The first zipper profile member 54 extends from the base strip 52 by way of a stem 62. At a free end of the stem 62, that is, at the tip of the first closure member 54, is a head 64. The head 64 is wider than the stem 62, such that it forms first and second shoulders 66, 67.

In this embodiment, the second zipper profile member 56 includes a pair of legs 68, 69 extending from the base strip 52. At the ends of each leg 68, 69 is an inwardly protruding foot 70, 71. In this embodiment, each foot 70, 71 is angled generally inwardly in a direction toward the base strip 52.

Turning now to the second closure profile 48, it includes a sealing flange 74, a base strip 76, a first zipper profile member 78, a second zipper profile member 80, and an upper flange 82. In this embodiment, the upper flange 82 includes an optional plurality of gripper ridges 84, which are aligned relative to the gripper ridges 60 on the upper flange 58 so that they nest with each other. As can also be seen in FIG. 2, in this embodiment, the upper flange 82 has a free end 86 that extends longer and beyond a free end 59 of the upper flange 58. These features of the gripper ridges 60, 84 and the free end 86 extending farther than the free end 59 help to provide a reclosable closure mechanism 12 that is easier to grasp and manipulate.

Still in reference to FIG. 2, the first zipper profile member 78 includes a pair of legs 88, 89 extending from the base strip 76. Each of the legs 88, 89 has a foot 90, 91. In this embodiment, each foot 90, 91 is shown extending from its respective leg 88, 89 and angled generally in a direction toward the base strip 76.

A first zipper closure 94 comprises one of the zippers of the double zipper 14, and the first zipper closure 94 is formed by releasable interlocking of the first zipper profile member 78 and the first zipper profile member 54. In particular, the head 64 of the first zipper profile member 54 is releasably snapped in place between the legs 88, 89. Each foot 90, 91 is engaged against the first and second shoulder 66, 67. This forms a selectively resealable and openable closure.

The second zipper profile member 80, in this embodiment, is shown as a stem 96 extending from the base strip 76. At the end of the stem 96 is a head 98. The head 98 is wider than the stem 96, and forms first and second shoulders 100, 101. The combination of the second zipper profile member 80 and the second zipper profile member 56 forms a second zipper closure 104. In particular, the head 98 snaps between the legs 68, 69, and each foot 70, 71 engages against the shoulders 100, 101.

In an optional embodiment, the double zipper 14 may have certain portions of the zipper profile members 54, 56, 78, 80 colored in order to create a special visual effect. In FIG. 2, it can be seen that the legs 88, 89 of the first zipper profile member 78, as well as the legs 68, 69 of the second zipper profile member 56 are shaded to indicate color. This may assist the user in learning that the double zipper 14 is closed.

The double zipper 14 includes the first zipper closure 94 and the second zipper closure 104. In this embodiment, the first zipper closure 94 is adjacent to the top edge 38 and the mouth 36. The second zipper closure 104 is located between the first zipper closure 94 and the bottom 28. The geometry of the first and second zipper closures 94, 104 may be changed, depending upon the application.

In this embodiment, the first and second zipper closures 94, 104 are spaced sufficiently close such that a single operation of pressing the fingers across the bag 10 will close both zipper closures 94, 104. The zipper closures 94, 104, however, are not spaced so close together that the user cannot tell that there are 2 closures. In preferred embodiments, the first zipper closure 94 and the second zipper closure 104 are spaced about 0.134+/−0.10 inches apart from each other, as measured on center of each zipper closure 94, 104. That is, when the first zipper closure 94 is measured from the center of the stem 64 to the second zipper closure 104 at the center of the stem 96, this distance will be about at least 0.124 inch and no greater than 0.144 inch apart from each other.

Each sealing flange 50, 74 is attached to a respective opposing bag wall 20, 22 at attachment locations 51, 75 (FIG. 2) through appropriate techniques. Such techniques can include heat sealing or adhesive. As mentioned above, it is also possible to extrude the first closure profile 46 and second closure profile 48 with the same material as the bag wall 16.

The first and second closure profiles 46, 48 are designed to engage with one another to form the double zipper 14, including the first zipper closure 94 and second zipper closure 104. The first and second zipper profile members 54, 56 extend from the base strip 52 a first distance. The first and second zipper profile members 78, 80 extend from the base strip 76 a first distance. These first distances are sufficient to allow mechanical engagement or interlocking, between the profile member 54 and profile member 78, as well as the profile member 56 with the profile member 80.

The first and second zipper closures 94, 104 are sealed along the first and second side edges 24, 26 in a way that ensures there will be no leakage at this point. Such sealing may include ultrasonic crushing, as one example. Other techniques may be used.

Turning again to FIG. 1, the first zipper closure 94 has a first side seal 110 adjacent to the first side edge 24. The first zipper closure 94 has a second side seal 111 adjacent to the second side edge 26. In FIG. 1, it can be seen how the first side seal 110 defines an end 112 that is at or adjacent to the first side edge 24. The first side seal 110 also includes a remote end 113 that is spaced closer to the second side edge 26 than the end 112.

The second side seal 111 includes an end 116 that is at or adjacent to the second side edge 26. The second side seal 111 also includes a remote end 117 that is spaced closer to the first side edge 24 than the end 116. As such, the first side seal 110 is defined between end 112 and remote end 113, while second side seal 111 is defined between end 116 and remote end 117.

The second zipper closure 104 has a third side seal 120 adjacent to the first side edge 24. The second zipper closure 104 has a fourth side seal 121 adjacent to the second side edge 26.

The third side seal 120 has an end 122 at or adjacent to the first side edge 24. The third side seal 120 also includes a remote end 123 that is spaced closer to the second side edge 26 than the end 122. As such, the third side seal 120 is defined between the end 122 and the remote end 123.

The fourth side seal 121 includes an end 126 at or adjacent to the second side edge 26. The fourth side seal 121 also includes a remote end 127 that is spaced closer to the first side edge 24 than the end 126. As such, the fourth side seal 121 is defined between end 126 and remote end 127.

In FIG. 1, at least one of the first side seal 110 and third side seal 120 has its remote end 113, 123 that is spaced closer to the second side edge 26 than the other of the remote end 113 of the first side seal 110 and remote end 123 of the third side seal 120.

In the embodiment shown in FIG. 1, the remote end 123 of the third side seal 120 is spaced closer to the second side edge 26 than the remote end 113 of the first side seal 110 is spaced to the second side edge 26. In other words, as can be seen in FIG. 1, the remote end 123 extends inwardly along the double zipper 14 farther than the remote end 113 of the first side seal 110. In practice, what this means is that the second zipper closure 104 will complete its closing operation before the first zipper closure 94 completes its closing operation, since the second zipper closure 104 ends at remote end 123 before the first zipper closure 94 ends at remote end 113. That is, the end 113 of the first zipper closure 94 is along a different linear location than the end 123 of the second zipper closure 104. By stating that the ends 113, 123 are along "different linear locations" it is meant that as an imaginary line perpendicular to both the first zipper closure 94 and second zipper closure 104 moves from one side edge 24, 26 to the other side edge 24, 26, the imaginary line will cross one of the ends 113, 123 before the other of the ends 113, 123.

In this embodiment, the second zipper closure 104 is also shorter than the first zipper closure 94. When the second zipper closure 104 completes its closing operation, it will result in sensory feedback, for example, an audible sound, such as a click. It may also result in tactile feedback, such as a feeling a snap or a give in material as the opposing closures mate or interlock. The click will have a sound level of at least 50 decibels, for example, about 60-70 decibels. Similarly, the first zipper closure 94, when it completes its closing operation, there will be an audible click of at least 50 decibels, preferably about 60-70 decibels. The user will hear or feel first and second separate and successive, and distinct audible clicks or snaps at different linear points along the double zipper 14, and know that the double zipper 114 is closed because the user heard both the second zipper closure 104 and the first zipper closure 94 click closed.

Still in reference to FIG. 1, in this embodiment, at least one of the second side seal 111 and fourth side seal 121 has its remote end 117, 127 spaced closer to the first side edge 24 than the other of the remote ends 117, 127 of the second side seal 111 and fourth side seal 121. In FIG. 1, it can be seen that the remote end 127 is spaced inwardly along the double zipper 114 further in than the remote end 117 of the second side seal 111. As explained above, this difference in lateral spacing of the remote end 127 versus the remote end 117 results in sensory feedback, such as an audible click and/or a tactile snap for the second zipper closure 104 before the first zipper closure 94 adjacent to the second side edge 26, when closing the double zipper 114 from a direction of the first side edge 24 to the second side edge 26.

In FIG. 1, the third side seal end 123 is spaced closer to the second side edge 26 than the first side seal end 113. Further, in the preferred embodiment, the fourth side seal end 127 is spaced closer to the first side edge 24 than the second side seal end 117.

Figure 4:
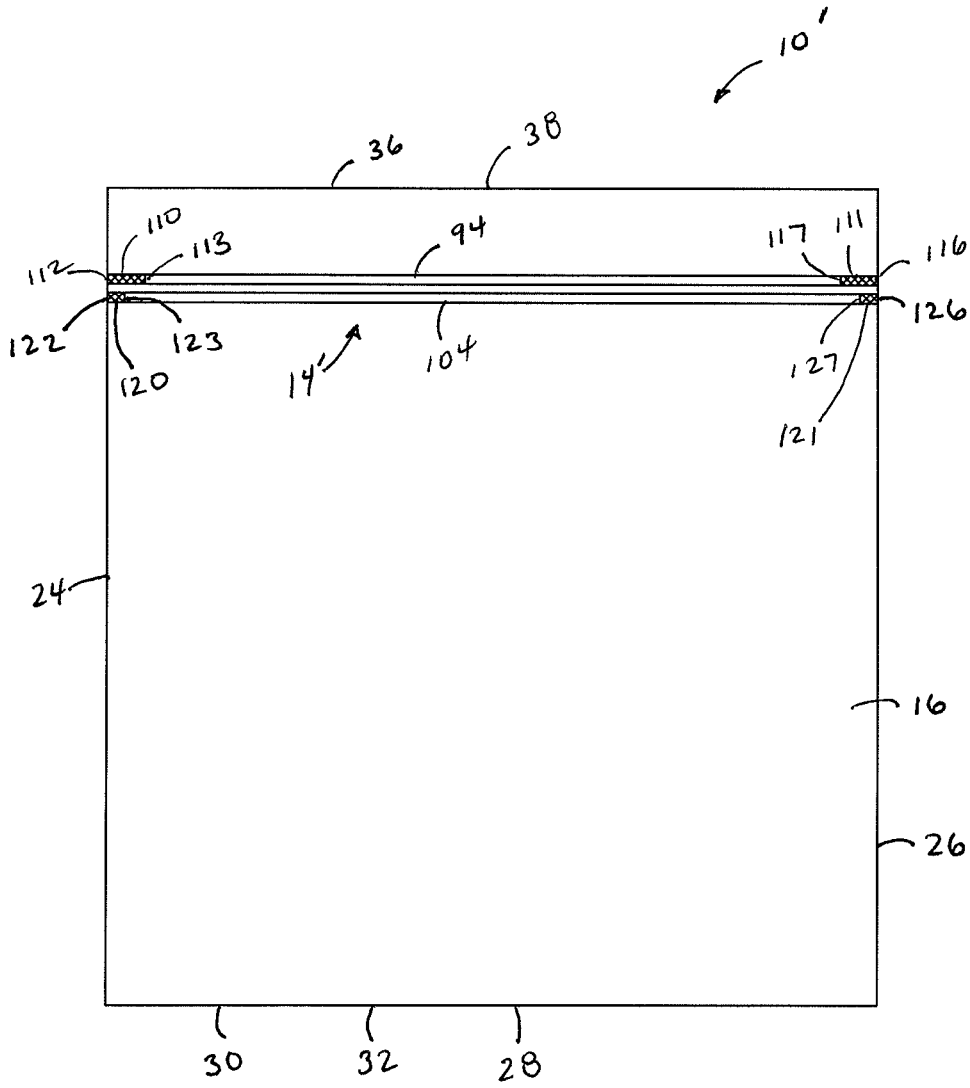
FIG. 4 is a front view of a third embodiment of a reclosable bag constructed in accordance with principles of this disclosure.

FIG. 4 shows an alternative embodiment of bag 10' with double zipper 14', in which the first side seal end 113 is spaced closer to the second side edge 26 than the third side seal end 123. In addition, in FIG. 4, the second side seal end 117 is spaced closer to the first side edge 24 than the fourth side seal end 127. In FIG. 4, the first zipper closure 94 is shorter than the second zipper closure 104. As a user closes the double zipper 14' in FIG. 4, the user will hear the audible click (and/or feel the tactile snap) of the first zipper closure 94 before the click/snap of the second zipper closure 104. Of course, there could be other embodiments including a combination of FIGS. 1 and 4, in which, for example, the first side seal end 113 is spaced closer to the second side edge 26 than the third side seal end 123; while in the second zipper closure 104, the fourth side seal end 127 is spaced closer to the first side edge 24 than the second side seal end 117.

In the embodiments of FIGS. 1 and 4, each of the ends 112, 116, 122, and 126 are shown at and even with or approximately even with its respective side edge 24, 26. In other embodiments, however, any one of these ends 112, 116, 122, and 126 can be spaced apart from the respective side edge 24, 26.

Figure 3:
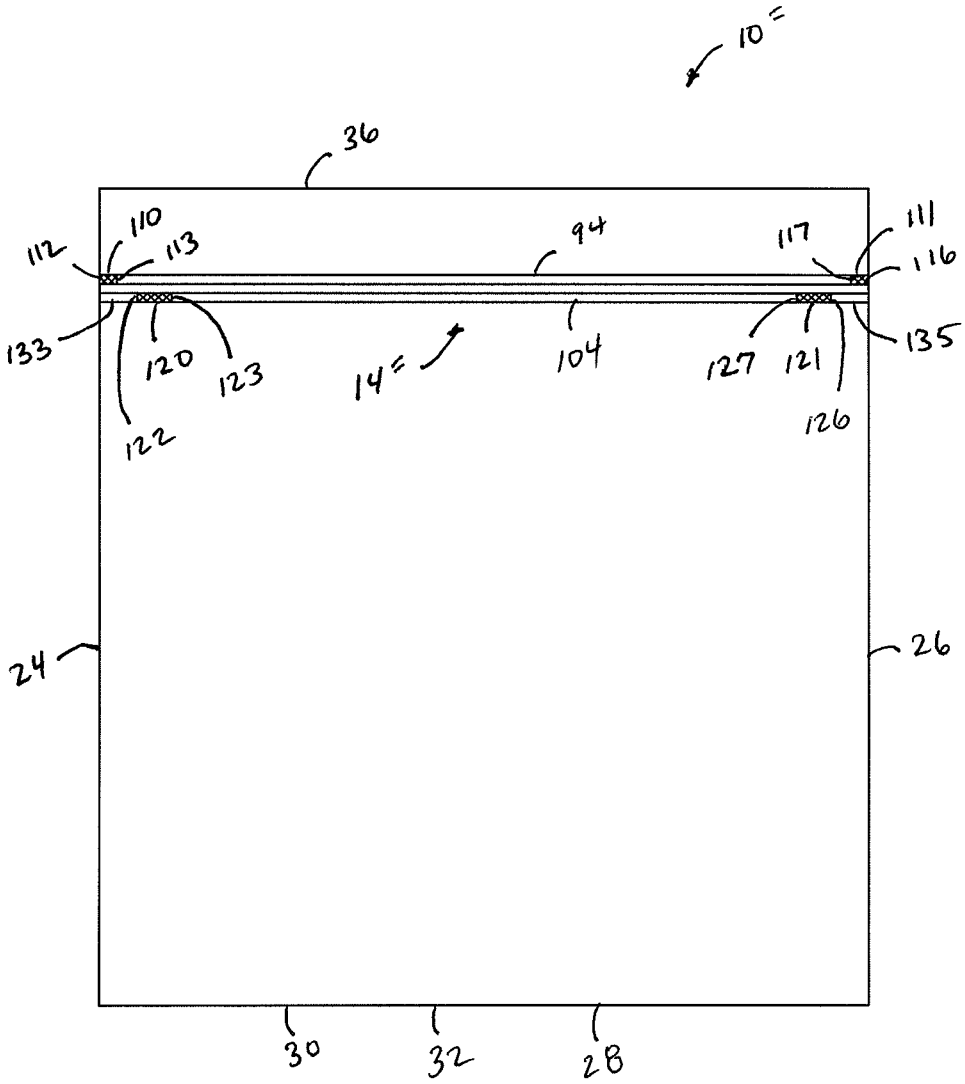
FIG. 3 is a front view of a second embodiment of a reclosable bag, constructed in accordance with principles of this disclosure.

For example, in the embodiment of bag 10" having double zipper 14" in FIG. 3, at least one of the third side seal 120 and first side seal 110 is spaced away from the first side edge 24. At least one of the fourth side seal 121 and second side seal 111 is spaced away from the second side edge 26.

In the embodiment shown in FIG. 3, the third side seal 120 having end 122 is spaced apart or away from the first side edge 24, while the fourth side seal 121 with end 126 is spaced away from the second side edge 26. It should be noted that the region 133 of the second zipper closure 104 between the end 122 and the first side edge 24 is sealed closed, and cannot open. Similarly, the region 135 between the end 126 and the second side edge 26 is closed and cannot open. Of course, variations are contemplated applying these principles.

Each of the first side seal 110, second side seal 111, third side seal 120, and fourth side seal 121 defines a length between its respective end and remote end that is at least 1/16 inches, no greater than 3/8 inches, and typically 1/8-1/4 inches.

C. Methods

A method of making the reclosable bag 10 includes providing an openable and reclosable double zipper, such as double zipper 14. The double zipper 14 includes first zipper closure 94 and second zipper closure 104. The double zipper 14 is secured to the opposing walls 20, 22 of the bag body 16, such as the surrounding wall 16, so that the first zipper closure 94 is adjacent to the open mouth 36, and the second zipper closure 104 is between the first zipper closure 94 and the closed bottom 28. Further, the first and second zipper closures 94, 104 are between the first side edge 24 and second side edge 26.

Next, the first side seal 110 is provided adjacent to the first side edge 24 for the first zipper closure 94. The second side seal 111 is provided adjacent to the second side edge 26 for the first zipper closure 94. The third side seal 120 is provided adjacent to the first side edge 24 for the second zipper closure 104. The fourth side seal 121 is provided adjacent to the second side edge 26 for the second zipper closure 104. These side seals 110, 111, 120, 121 may be created by ultrasonics, such as ultrasonic crushing, to ensure that the first closure 94 and second closure 104 do not leak at edges 24, 26.

There is a step of making at least one of the first side seal 110 and third side seal 120 to have an end 113, 123 that is spaced closer to the second side edge 26 than the other end 113, 123 of the first side seal 110 and third side seal 120.

Preferably, the method includes making at least one of the second side seal 111 and fourth side seal 121 to have an end 117, 127 that is spaced closer to the first side edge 24 than the other remote end 117, 127 of the second side seal 111 and fourth side seal 121.

The step of providing the double zipper 14 includes providing the first and second zipper closures 94, 104 to be spaced no more than 0.144 inches apart from each other. Preferably, securing the double zipper 14 to the opposing walls 20, 22 includes heat sealing the double zipper 14 to the opposing walls 20, 22.

A method for providing a sensory indication of double sealing in the reclosable bag 10 includes providing the bag 10 with bag body having surrounding wall 16, bottom 28, open mouth 26, and openable and reclosable double zipper 14 for opening and closing the mouth 26. The double zipper 14 includes the first openable and reclosable zipper closure 94 adjacent to the mouth 36, and the second openable and reclosable zipper closure 104 between the first zipper closure 94 and the bottom 28.

Next, there is a step of closing the open mouth 36 by pressing opposing fingers against the first and second zipper closures 94, 104 and moving opposing fingers linearly across the first and second zipper closures 94, 104 from one side edge 24, 26 to the other side edge 24, 26 until there is a sensory indication of an end seal for each of the first and second zipper closures 94, 104 at different linear locations.

For example, the method of closing the mouth can include simultaneously pressing the first and second zipper closures 94, 104 between opposing fingers and sliding the fingers across the first and second zipper closures 94, 104 from either the first side edge 24 to the second side edge 26 (or from the second side edge 26 to the first side edge 24) until hearing the first and second separate, distinct, and successive audible clicks, at different linear locations along the double zipper 14, with each click having at least 50 decibels. Or, as another example, the sensory indication can be receiving tactile feedback, such as feeling a snap, or release of tension, or give in material, as the opposing zipper closures mate.

In particular, for example, the step of closing the mouth and sliding the fingers across the first and second zipper closures 94, 104 includes closing the first and second zipper closures 94, 104 by mating the first zipper profile member 54 with the first zipper profile member 78, and mating the second zipper profile member 56 with the second zipper profile member 80. Eventually, one of the first zipper closures 94 and second zipper closures 104 will complete its mating or interlocking before the other. In the embodiment shown in FIGS. 1 and 3, the second zipper closure 104 will complete its interlocking, mating, or closing before the first zipper closure 94. When this happens, there will be the first audible click and/or tactile snap produced as the second zipper closure 104 terminates at either remote end 123 or remote end 127. After this first audible click and/or tactile snap, the first zipper closure 94 will complete its mating, interlocking, or closure as it encounters either remote end 113 or remote end 117, to result in the second audible click.

To open the double zipper 114, the upper flange is 58, 82 are grasped, and pulled apart from each other. As they are pulled apart, the first zipper profile member 54 is pulled from interlocking or mating with the first zipper profile member 78, and the second zipper profile member 56 is pulled apart from interlocking or mating with the second zipper profile member 80. This opens the mouth 36 and provides access to the interior 34.

The above represents example principles of the disclosure. Many embodiments can be made.

What is claimed is:

1. A reclosable bag comprising:

(a) a bag surrounding wall defining an enclosure; the bag surrounding wall including:

(i) a closed bottom;

(ii) an open mouth opposite of the closed bottom and providing access to the enclosure;

(iii) a first side edge extending from the mouth to the bottom; and (iv) a second side edge, opposite of the first side edge, extending from the mouth to the bottom;

(b) an openable and reclosable double zipper integral with the bag surrounding wall and adjacent to the mouth; the double zipper being slider-free and including:

(i) a first openable and reclosable zipper closure adjacent to the mouth;

(A) the first zipper closure having a first side seal adjacent to the first side edge;

(B) the first zipper closure having a second side seal adjacent to the second side edge;

(ii) a second openable and reclosable zipper closure between the first zipper closure and the closed bottom;

(A) the second zipper closure having a third side seal adjacent to the first side edge;

(B) the second zipper closure having a fourth side seal adjacent to the second side edge;

(c) at least one of the first side seal and third side seal has an end that is spaced closer to the second side edge than the other of the first side seal and third side seal; and (d) at least one of the second side seal and fourth side seal has an end that is spaced closer to the first side edge than the other of the second side seal and fourth side seal.

2. The reclosable bag of claim 1 wherein:

(a) the first and second zipper closures are spaced no more than 0.144 inches apart from each other.

3. The reclosable bag of claim 1 wherein:

(a) the first side seal end is spaced closer to the second side edge than the third side seal end; and (b) the second side seal end is spaced closer to the first side edge than the fourth side seal end.

4. The reclosable bag of claim 1 wherein:

(a) the third side seal end is spaced closer to the second side edge than the first side seal end; and (b) the fourth side seal end is spaced closer to the first side edge than the second side seal end.

5. The reclosable bag of claim 1 wherein:

(a) at least one of the third side seal and first side seal is spaced away from the first side edge.

6. The reclosable bag of claim 1 wherein:

(b) at least one of the fourth side seal and second side seal is spaced away from the second side edge.

7. The reclosable bag of claim 4 wherein:

(a) the third side seal is spaced away from the first side edge; and (b) the fourth side seal is spaced away from the second side edge.

8. The reclosable bag of claim 1 wherein:

(a) the double zipper includes profile flanges secured to the bag surrounding wall.

9. The reclosable bag of claim 1 wherein:

(a) the double zipper is a one piece extrusion with the bag surrounding wall.

10. The reclosable bag of claim 1 wherein:

(a) the first side seal, second side seal, third side seal, and fourth side seal are ultrasonically crushed material.

11. A method of making a recloseable bag comprising:

(a) providing an openable and recloseable double zipper including:

(i) a first openable and recloseable zipper closure;

(ii) a second openable and recloseable zipper closure;

iii) the double zipper being slider-free;

(b) securing the double zipper to opposing walls of a bag body so that the first zipper closure is adjacent an open mouth, the second zipper closure is between the first zipper closure and a closed bottom, and the first and second zipper closures are between a first side edge, and a second side edge;

(i) providing a first side seal adjacent to the first side edge for the first zipper closure;

(ii) providing a second side seal adjacent to the second side edge for the first zipper closure;

(iii) providing a third side seal adjacent to the first side edge for the second zipper closure; and (iv) providing a fourth side seal adjacent to the second side edge for the second zipper closure; and (c) making at least one of the first side seal and third side seal to have an end that is spaced closer to the second side edge than the other of the first side seal and third side seal; and (d) making at least one of the second side seal and fourth side seal to have an end that is spaced closer to the first side edge than the other of the second side seal and fourth side seal.

12. The method of claim 11 wherein:

(a) the step of providing an openable and recloseable double zipper includes providing the first and second zipper closures to be spaced no more than 0.144 inches apart from each other.

* * * * *